US010147408B2

(12) United States Patent
Ishibashi et al.

(10) Patent No.: US 10,147,408 B2
(45) Date of Patent: Dec. 4, 2018

(54) CONNECTION SETTING OF TONE PROCESSING MODULE

(71) Applicant: Yamaha Corporation, Hamamatsu-shi, Shizuoka-ken (JP)

(72) Inventors: Masao Ishibashi, Hamamatsu (JP); Naoya Sasaki, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 15/340,907

(22) Filed: Nov. 1, 2016

(65) Prior Publication Data

US 2017/0124998 A1 May 4, 2017

(30) Foreign Application Priority Data

Nov. 2, 2015 (JP) ..... 2015-215890

(51) Int. Cl.
*G10H 1/18* (2006.01)
*G10H 1/28* (2006.01)

(52) U.S. Cl.
CPC ..... *G10H 1/183* (2013.01); *G10H 1/28* (2013.01); *G10H 2220/005* (2013.01)

(58) Field of Classification Search
CPC ..... G10H 1/183; G10H 1/28; G10H 2220/005
USPC ..... 84/615
See application file for complete search history.

(56) References Cited

U.S. PATENT DOCUMENTS 4,179,970 A * 12/1979 Faulkner ..... G10H 1/28 84/715
4,624,170 A * 11/1986 Ohno ..... G10H 1/28 84/622
5,425,297 A * 6/1995 Young, Jr. ..... G10H 1/34 84/479 A
5,714,705 A * 2/1998 Kishimoto ..... G10H 1/28 84/611
5,895,878 A * 4/1999 Ishibashi ..... G10H 7/008 84/626
5,898,120 A * 4/1999 Kira ..... G10H 1/28 84/638
5,920,025 A * 7/1999 Itoh ..... G10H 1/36 84/611
5,942,710 A * 8/1999 Hayakawa ..... G10H 1/38 84/637

(Continued)

FOREIGN PATENT DOCUMENTS

JP H-10-274985 A 10/1998

*Primary Examiner* — David Warren
*Assistant Examiner* — Christina Schreiber
(74) *Attorney, Agent, or Firm* — Morrison & Foerster LLP

(57) ABSTRACT

A first input section is used for inputting first tone data, and a first output section is connected to the first input section via a first path. A second input section is used for inputting second tone data, and a second output section is connected to the second input section via a second path. A tone processing module performs tone processing on the tone data, and a processor is configured to insert the tone processing module into the first and second paths in response to selection of first and second modes, respectively. The tone processing module performs the tone processing on the first tone data in the first mode, and performs the tone processing on the second tone data in the second mode. The above allows connection of the module to be set easily in response to the selected mode.

16 Claims, 4 Drawing Sheets

(56) References Cited

U.S. PATENT DOCUMENTS

| | | | | | |
|---|---|---|---|---|---|
| 5,973,253 | A * | 10/1999 | Hirata | G10H 3/186 | 84/609 |
| 5,973,254 | A * | 10/1999 | Yamamoto | G10H 1/0066 | 84/609 |
| 6,166,316 | A * | 12/2000 | Takahashi | G10H 1/28 | 84/619 |
| 6,177,626 | B1 * | 1/2001 | Ishibashi | G10H 1/0008 | 84/477 R |
| RE37,654 | E * | 4/2002 | Longo | G10H 1/02 | 84/600 |
| 2004/0112203 | A1 * | 6/2004 | Ueki | G10H 1/0008 | 84/613 |
| 2005/0016366 | A1 * | 1/2005 | Ito | G10H 1/28 | 84/716 |
| 2008/0072744 | A1 * | 3/2008 | Ito | G10H 1/28 | 84/638 |
| 2008/0072745 | A1 * | 3/2008 | Ito | G10H 1/28 | 84/638 |
| 2013/0215070 | A1 * | 8/2013 | Sasaki | G06F 3/041 | 345/173 |
| 2015/0013532 | A1 * | 1/2015 | Adam | G10H 1/28 | 84/638 |
| 2017/0124998 | A1 * | 5/2017 | Ishibashi | G10H 1/183 | |

* cited by examiner

CONNECTION SETTING OF TONE PROCESSING MODULE

BACKGROUND

The present invention relates generally to musical equipment provided with a tone processing module for performing some kind of processing on input tone data such as an electronic musical instrument provided with an arpeggiator (arpeggio generator), and a program for such musical equipment. More particularly, the present invention relates to a technique for setting connections of the tone processing module.

Heretofore, there have been known electronic musical instruments provided with an arpeggiator that automatically generates arpeggio performance tones in response to depressing operations of one or more keys on a keyboard. In a case where such an electronic musical instrument is used by being connected to external equipment, a user can select whether arpeggio performance tones automatically generated in response to key depressing operations should be output to the external equipment or not. According to the disclosure in Japanese Patent Application Laid-open Publication No. HEI-10-274985 (hereinafter referred to as "Patent Literature 1") for example, there is a need to make settings for two switches: a first switch for selecting, as input to an arpeggiator, either of performance information corresponding to key depression and performance information input from external equipment; and a second switch for selecting, as output to the external equipment, either of arpeggio performance information output from the arpeggiator and performance information having not being passed through (i.e., input to and processed by) the arpeggiator.

Further, it is also known in the art that, in a music production environment where external equipment, such as a personal computer, is connected to an electronic musical instrument, various functions are implemented by communication (transmission and reception) of various data between the electronic musical instrument and the external equipment. Such various functions include: recording performance information, output from the electronic musical instrument, into the external equipment; and reproducing (playing back) performance information, recorded in the external equipment, by the electronic musical instrument. For example, as one recording method for recording an arpeggio performance, corresponding to a performance executed on the electronic musical instrument, into the external equipment in the music production environment, there has been known a recording method (hereinafter "recording method (1)") in which arpeggio performance information generated or created by the arpeggiator in response to keyboard operation is recorded into the external equipment. According to such recording method (1), it is necessary, at the time of the recording, that input from the external equipment be set OFF (i.e., set to an OFF state) in the electronic musical instrument to thereby make a setting such that arpeggio performance information currently recorded into the external equipment does not return to the electronic musical instrument. Further, at the time of reproduction of the arpeggio performance information recorded in the external equipment, it is necessary that the arpeggiator be turned off (deactivated) so that the arpeggio performance information recorded in the external equipment is input to and reproduced by the electronic musical instrument without being passed through the arpeggiator. Namely, in the electronic musical instrument, the ON/OFF setting of the arpeggiator and the external input setting need to be changed so as to differ between the time when the recording is to be performed and the time when the reproduction is to be performed.

As another recording method for recording an arpeggio performance in the music production environment, there has been known a recording method (hereinafter "recording method (2)") in which performance information having not been passed through the arpeggiator is recorded into the external equipment and in which, at the time of reproduction of the recorded performance information, the recorded performance information is input to the electronic musical instrument and then reproduced after being passed through the arpeggiator. In order to appropriately use aforementioned recording method (1) and recording method (2) depending on the cases, it is necessary to combine various settings, such as settings of input to the arpeggiator and output from the arpeggiator, external output setting, external input setting and ON/OFF setting of the arpeggiator.

Further, in the music production environment where external equipment, such as a personal computer, is connected to an electronic musical instrument, it is necessary to differentiate various settings between a case where the electronic musical instrument is used connected to the personal computer and a case where the electronic musical instrument is used disconnected from the personal computer.

Namely, in the music production environment where external equipment, such as a personal computer, is connected to an electronic musical instrument, it is necessary to make appropriate settings depending on various scenes of use. Further, mechanisms of such settings of the electronic musical instrument are very complicated and difficult for a user to follow.

Above-identified Patent Literature 1, for example, discloses a technique for shifting the output destination of a tone processing module depending on scenes of use in a digital audio mixer which includes a plurality of channels and in which an effecter can be inserted in any one or more of the channels. According to the disclosure of Patent Literature 1, an interlock mode can be set, and when a particular effecter is selected as an object to be edited while the interlock mode is ON, an audio signal of the channel having the effecter inserted therein is output from a monitor output.

SUMMARY OF THE INVENTION

In view of the foregoing problems, it is an object of the present invention to provide an improved technique which can facilitate connection setting of a tone processing module that performs tone processing on input tone data.

In order to accomplish the above-mentioned object, the present invention provides improved musical equipment, which comprises: a first input section to which first tone data is input: a second input section to which second tone data is input; a first output section connected to the first input section via a first path; a second output section connected to the second input section via a second path; a tone processing module that performs tone processing on input tone data: and a processor configured to insert the tone processing module into the first path in response to selection of a first mode (connection mode) and insert the tone processing module into the second path in response to selection of a second mode (connection mode). The tone processing module performs tone processing on the first tone data, input via the first input section, in the first mode, and performs tone processing on the second tone data, input via the second input section, in the second mode.

According to the present invention, because control is performed such that the tone processing module is inserted into the first path in response to selection of the first mode and the tone processing module is inserted into the second path in response to selection of the second mode, connection settings of the tone processing module can be changed or switched according to the selected mode. Namely, with the present invention, connections of the tone processing module can be set appropriately by merely selecting any one of the first mode and second mode depending on a situation or scene of use of the musical equipment. In this way, the present invention can appropriately set connections of (to and from) the tone processing module depending on a scene of use of the musical equipment, in a simple and intuitively-easy-to-follow manner as compared to the conventionally-known technique where respective settings of a plurality of switches etc. have to be combined.

In one embodiment of the present invention, the aforementioned processor may be configured to move or positionally shift the tone processing module to be inserted into any one of the first path and second path depending on which of the first mode and the second mode is currently selected. Accordingly, the number of tone processing modules can be reduced, leading to suppression of consumption of resources, such as a memory, as compared to a construction where, for example, a plurality of tone processing modules are prepared in association with the first and second paths and ON/OFF settings are made for respective validity/invalidity of the tone processing modules.

In one embodiment of the present invention, the first output section is connected to an external input section of external equipment, and the second input section is connected to an external output section of the external equipment. When the first mode is selected, the first tone data, having been subjected to the tone processing by the tone processing module, is output from the first output section to the external equipment, so that, with the external equipment, the first tone data, having been subjected to the tone processing, is, for example, subjected to a direct output process such that the first tone data, externally input to the external equipment, is output directly (as-is) and then input to the second input section as the second tone data. On the other hand, when the second mode is selected, the first tone data, having not been subjected to the tone processing, is output from the first output section to the external equipment and then input to the second input section as the second tone data. In this case, for example, in the first mode, the tone data, having been subjected to the tone processing and output from the musical equipment, can be recorded into the external equipment, and the processed tone data thus recorded in the external equipment can be returned to and reproduced in the musical equipment, in the second mode the tone data, output from the musical equipment without being subjected to the tone processing, can be recorded into the external equipment, and then can be returned to the musical equipment and subjected to the tone processing and then reproduced. In this way, the present invention can readily realize connection settings suited for two different recording schemes by merely selecting the first mode and second mode depending on a scene of use. Further, according to the present invention, there is no need for setting change of the musical equipment between recording of the tone data and reproduction of the tone data in each of the first mode and second mode.

Further, in one embodiment of the present invention, the tone processing module may comprise an arpeggiator that automatically generates or creates arpeggio performance information, indicative of arpeggio performance tones (or notes), based on the input tone data. In another embodiment of the present invention, the tone processing module may comprise an effecter that imparts a sound effect to the input tone data. In still another embodiment of the present invention, the tone processing module may be configured to perform any other tone processing on the input tone data.

The present invention may be constructed of a dedicated apparatus or circuitry configured to perform necessary functions, or by a combination of program modules configured to perform their respective functions and a processor (e.g., a general-purpose processor like a CPU, or a dedicated processor like a DSP) capable of executing the program modules.

The present invention may be constructed and implemented not only as the apparatus invention discussed above but also as a computer-implemented method invention comprising steps of performing various functions. Also, the present invention may be implemented as a program invention comprising a group of instructions executable by a processor configured to perform the method. In addition, the present invention may be implemented as a non-transitory computer-readable storage medium storing the program.

The following will describe embodiments of the present invention, but it should be appreciated that the present invention is not limited to the described embodiments and various modifications of the invention are possible without departing from the basic principles of the invention. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which:

FIGS. 1A and 1B are block diagrams conceptually showing an example overall setup of an electronic musical instrument to which are applied an embodiment of musical equipment of the present invention, of which FIG. 1A shows connection settings when a first mode is selected in the electronic musical instrument and FIG. 1B shows connection settings when a second mode is selected in the electronic musical instrument;

DETAILED DESCRIPTION

Figure 1A:
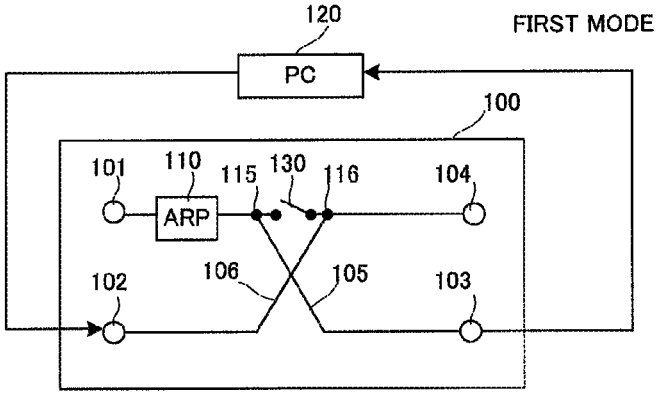
Figure 1B:
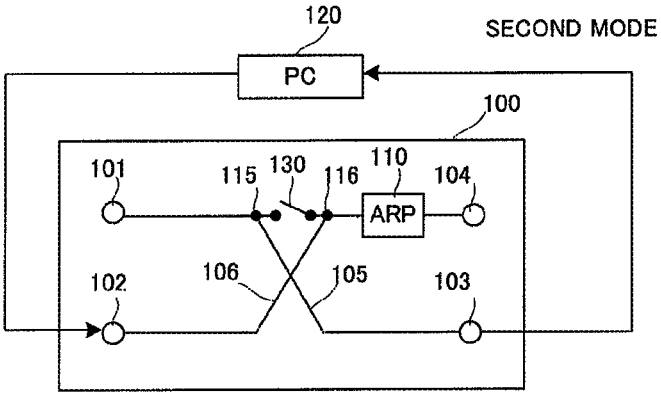

FIGS. 1A and 1B are block diagrams conceptually showing an example overall setup of an electronic musical instrument to which are applied an embodiment of musical equipment of the present invention. As shown in these figures, the electronic musical instrument 100 includes: a first input section 101 that inputs first tone data; a second input section 102 that inputs second tone data a first output section 103 corresponding to the first input section 101, a second output section 104 corresponding to the second input section 102; and an effect module 110 that performs an effect process on the first tone data or second tone data.

In the illustrated example, the first tone data and second tone data each comprise performance information prepared in the MIDI (Musical Instrument Digital Interface) format. The first input section 101 comprises, for example, a performance operation section, such as a keyboard having a plurality of keys, that are adapted to input performance information corresponding to a performance operation. The second input section 102 comprises, for example, an external input section that is connected to an output section of external equipment, such as a personal computer (hereinafter referred to as "PC") 120, and receives or inputs performance information from the PC 120. The first output section 103 comprises an output section that is connected to an external input section the PC 120 and outputs performance information to the PC 120. Further, the second output section 104 comprises a tone generator section that generates a tone signal on the basis of performance information.

The PC 120 has stored therein a software program (hereinafter referred to also as "DAW software") for performing various music production functions, such as recording, reproduction (playback), editing etc. of performance information. As well known, the PC 120 can perform the various music production functions by the DAW software through communication (transmission and reception) of performance information and various data with the electronic musical instrument 100. For example, the PC 120 can record performance information, corresponding to a performance operation performed on the electronic musical instrument 100, into a recording function (i.e., MIDI sequencer) provided by the DAW software, transmit performance information recorded in the MIDI sequencer to the electronic musical instrument 100 so that a tone corresponding to the recorded performance information is reproduced by the tone generator section 104 of the electronic musical instrument 100, and turn on/off a direct output process for outputting performance information, externally input from the electronic musical instrument 100, to the outside directly as-is.

The tone processing module 110 comprises, for example, an arpeggiator ("ARP" in the figures) that automatically generates or creates arpeggio performance information based on input performance information. Namely, in the illustrated example, the arpeggiator (ARP) 110 functions as a tone processing module that performs tone processing (i.e., arpeggio tone generation processing) on input tone data. The arpeggio performance information is indicative of an arpeggio performance where tones of one or more pitches are sequentially sounded or audibly generated in accordance with an arpeggio pattern. The automatic creation process of arpeggio performance information by the arpeggiator 110 is a well-known technique and thus will not be described in detail here. The electronic musical instrument 100 of the present invention is characterized by changing connection settings of the arpeggiator 110 by positionally shifting the arpeggiator 110 in accordance with a selected connection mode. FIG. 1A shows connection settings of the arpeggiator 110 when a first mode is selected as the connection mode, and FIG. 1B shows connection settings of the arpeggiator 110 when a second mode is selected as the connection mode.

In the first mode shown in FIG. 1A, the arpeggiator 110 is inserted in a first path 105 interconnecting the performance operation section 101 and the first output section 103. Thus, performance information input via the performance operation section 101 is input to the arpeggiator 110, so that arpeggio performance information automatically created by the arpeggiator 110 is output from the first output section 103 to the PC 120. Arpeggio performance information is input from the PC 120 to the second input section 102, and the arpeggio performance information thus input to the second input section 102 is supplied to the tone generator section 104 without being passed through (i.e., input to and processed by) the arpeggiator 110. The tone generator section 104 generates tone signals, i.e. arpeggio performance tones, based on the supplied arpeggio performance information. Note that, in this case, the PC 120 is set in advance so as to output externally-input performance information to the outside directly as-is; namely, the direct output process is set in an ON state in advance (i.e., the direct output process is set ON in advance).

The connection settings in the first mode are settings suited for recording, into the PC 120, arpeggio performance information corresponding to a performance operation performed on the electronic musical instrument 100. In this case, at the time of the recording, it is possible to monitor, via the electronic musical instrument 100, arpeggio performance tones based on the arpeggio performance information that is currently being recorded into the PC 120, by returning the arpeggio performance information from the PC 120 to the second input section 102 of the electronic musical instrument 100 by the direct output process. Thus, in the case where the PC 120 is provided between the first output section 103 and the second input section 102 and the direct output process in the PC 120 is set in the ON state, the first output section 103 is directly connected to the second input section 102, and then the first mode is selected by a user or automatically so that output data of the arpeggiator (tone processing module) 110 from the first output section 103 is returned to the second input section 102, whereby the output data of the arpeggiator (tone processing module) 110 is supplied to the second output section (tone generator) 104. Further, by the PC 120 reproducing the recorded arpeggio performance information, arpeggio performance tones based on the arpeggio performance information being currently reproduced by the PC 120 can be sounded or audibly generated by the electronic musical instrument 100.

When the arpeggio performance information is to be recorded into the PC 120 with the connection settings in the first mode as above, a series of tone generation events, indicative of an arpeggio performance based on the arpeggio performance information automatically created in response to the performance operation, are sequentially recorded into the MIDI sequencer of the PC 120. For example, when a user has performed a chord for the length of one measure, a plurality of tone generation events with individual component tones of the chord sequentially distributed in accordance with a given arpeggio pattern are recorded for one measure. The arpeggio performance information recorded in the aforementioned manner allows the user to individually edit each of the tone generation events recorded in the MIDI sequencer, so that the recorded component tones of the arpeggio performance can be adjusted or changed one by one.

In the second mode shown in FIG. 1B, on the other hand, the arpeggiator 110 is inserted in a second path 106 interconnecting the second input section 102 and the tone generator section 104. In this case, performance information input via the performance operation section 101 is output from the first output section 103 to the PC 120 directly as-is, without being passed through the arpeggiator 110. The performance information is input from the PC 120 to the second input section 102, and the performance information thus input to the second input section 102 is input to the arpeggiator 110, and arpeggio performance information created by the arpeggiator 110 on the basis of the performance information is supplied to the tone generator section 104. The tone generator section 104 generates tone signals, i.e. arpeggio performance tones, based on the supplied arpeggio performance information. Note that, in this case too, the direct output process is set in the ON state in advance (i.e., set ON in advance).

The connection settings in the second mode are settings suited for recording, at the time of recording of performance information corresponding to a performance information performed on the electronic musical instrument 100, the performance information into the PC 120 without passing the performance information through the arpeggiator 110, and also suited for the electronic musical instrument 100 to execute, at the time of reproduction of the performance information recorded in the PC 120, an arpeggio performance based on the recorded performance information. In this case, at the time of the recording, it is possible to monitor, via the electronic musical instrument 100, arpeggio performance tones based on the arpeggio performance information being currently recorded into the PC 120, by returning to the second input section 102 of the electronic musical instrument 100 the arpeggio performance information currently being recorded into the PC 120. Further, at the time of the reproduction of the performance information recorded in the PC 120, the performance information currently being reproduced in the PC 120 is input to the arpeggiator 110 via the second input section 102, so that the electronic musical instrument 100 can audibly generate arpeggio performance tones based on arpeggio performance information created by the arpeggiator 110.

In recording performance information into the PC 120 with the aforementioned connection settings in the second mode, tone generation events corresponding to the performance information, corresponding to a performance operation, are recorded into the MIDI sequencer of the PC 120. If the user has performed a chord for the length of one measure, then tone generation events corresponding to individual tones constituting the chord are each recorded into the MIDI sequencer for the length of the one measure. Namely, at the time of recording, only pitches and time length of the performed chord are recorded as pitches and time length of individual tones constituting an arpeggio performance without an arpeggio pattern being determined at this stage. In this case, at the time of reproduction of performance information recorded in the PC 120, the user can select or change as desired, via the electronic musical instrument 100, an arpeggio pattern to be applied to the recorded performance information.

Further, a local control switch 130 is provided between a first branch point 115 in the first path 105 and a second branch point 116 in the second path 106. The local control switch 130 connects the branch points 115 and 116 to each other by turning on.

FIGS. 1A and 1B show states when the local control switch 130 is in the OFF state. When the first mode is set, as shown in FIG. 1A, the arpeggiator 110 is inserted upstream of the first branch point 115 in the first path 105; in other words, the first branch point 115 is located in the first path 105 downstream (i.e., at the output side) of the inserted position of the arpeggiator 110. When the second mode is set, as shown in FIG. 1B, the arpeggiator 110 is inserted downstream of the second branch point 116 in the second path 106; in other words, the second branch point 116 is located in the second path 106 upstream (at the input side) of the inserted position of the arpeggiator 110. Note that, in this specification, the terms "upstream" and "downstream" are used to refer to directions as viewed in the direction where performance information (first tone data and second tone data) flows from the input side to the output side; thus, the input side (i.e., left-hand side in FIGS. 1A and 1B) is the "upstream side", while the output side (i.e., right-hand side in FIGS. 1A and 1B) is the "downstream side".

Figure 2:
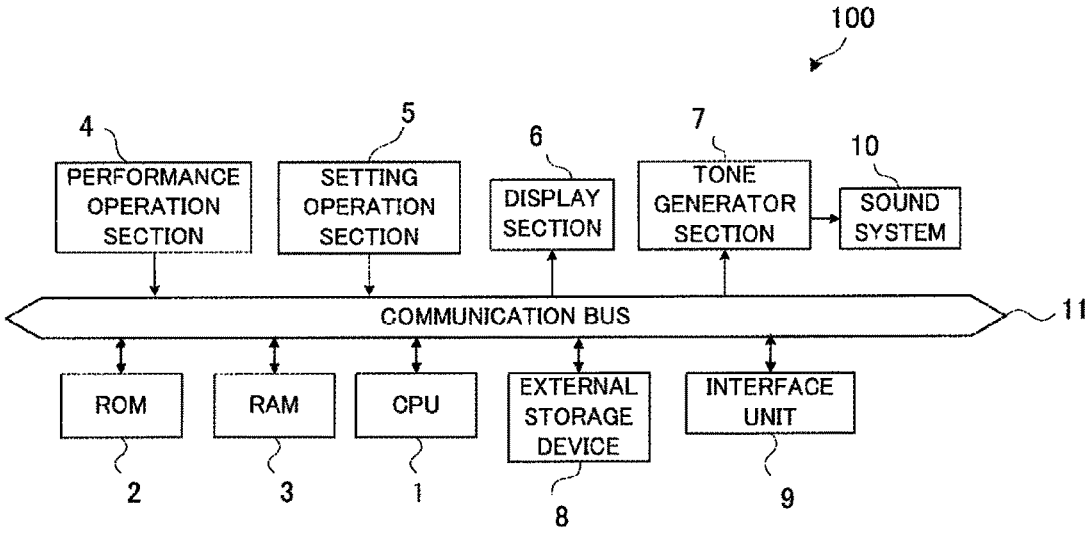
FIG. 2 is a block diagram showing an example overall electric hardware setup of the electronic musical instrument shown in FIG. 1.

FIG. 2 is a block diagram showing an example overall electric hardware setup of the electronic musical instrument 100. As shown, the electronic musical instrument 100 includes: a microprocessor unit (CPU) 1: a read-only memory (ROM) 2; a random access memory (RAM) 3; a performance operation section 4; a setting operation section 5; a display device 6; a tone generator circuit 7: an external storage device 8; and an interface unit 9. The CPU 1 is connected to the aforementioned various components 2 to 9 and can communicate various data and control signals with the components 2 to 9. As an example, the arpeggiator (tone processing module) 110 comprises a program module containing a group of instructions executable by a processor and is stored in a suitable memory (i.e., ROM 2, RAM 3 or external storage device 8), and the function of the arpeggiator (tone processing module) 110 is implemented by the program module being executed by the CPU 1.

The CPU 1 controls general behavior of the electronic musical instrument 100 by executing various programs stored in the ROM 2, RAM 3 or external storage device 8. The behavior to be controlled by the CPU 1 includes, among other things, various operations of the electronic musical instrument 100 shown in FIG. 1, such as creation of performance information, tone processing (automatic arpeggio tone generation) by the arpeggiator 110, input/output of performance information and connection setting. The ROM 2 and RAM 3 not only store various programs to be executed by the CPU 1 and various data but also are used as a loading area of a program to be executed by the CPU 1 and a working area for the CPU 1. The external storage device 8 may be any of various types, such as a hard disk, FD (Flexible Disk or Floppy (registered trademark) Disk (FD), CD (Compact Disk), DVD (Digital Versatile Disk), and a semiconductor memory like a flash memory.

The performance operation section 4 corresponds to the first input section 101 of FIGS. 1A and 1B and includes, for example, a keyboard having a plurality of keys. The performance operation section 4 also includes a mechanism for detecting operation events corresponding to operations performed on the keyboard such that, for each of the detected operation events, it outputs to a communication bus 11 a detection signal corresponding to the operation event. Each operation event corresponding to a key depressing operation includes a note No. indicative of a pitch of the depressed key, a key-on signal indicative of a tone generation start instruction, a velocity etc. Each operation event corresponding to a key releasing operation includes a note No. indicative of a pitch of the released key, a key-off signal indicative of a tone generation end instruction, etc.

The setting operation section 5 includes a group of switches for performing various setting, such as later-described mode selection and tone color setting, inputting various information, and a mechanism for detecting operation events corresponding to operations of the individual switches. For each of the detected operation events, the setting operation section 5 outputs to the communication bus 11 a detection signal corresponding to the operation event. The display device 6, which comprises for example a liquid crystal display, displays various information based on display control signals received from the CPU 1 via the communication bus 11.

Further, the tone generator circuit 7, which corresponds to the second output section 104 of FIGS. 1A and 1B, electronically generates a tone signal based on performance information supplied via the communication bus 11 and outputs the thus-generated tone signal to a sound system 10 connected to the tone generator circuit 7. The tone generator circuit 7 may employ any of the conventionally-known tone synthesis methods, such as the FM tone generator method, the PCM tone generator method and the physical model tone generator method. Further, the tone generator circuit 7 may be implemented by either a hardware tone generator device, or software processing by the CPU 1 or a not-shown DSP (Digital Signal Processor). The sound system 10 includes a digital-to-analog converter, an amplifier, a speaker, etc. and audibly outputs or sounds the tone signal generated by the tone generator circuit 7.

The interface unit 9 includes: general-purpose interfaces, such as a USB interface and an Ethernet (registered trademark) interface; a MIDI interface for communicating (transmitting and receiving) signals of the MIDI standard; and an audio interface for inputting and outputting audio signals from and to external equipment. The electronic musical instrument 100, which is connected to the PC 120 via the interface 9, can communicate (transmit and receive) various information, including MIDI signals, audio signals and various control signals, with the PC 120. The interface unit 9 corresponds to the second input section 102 and the first output section 103 of FIG. 1.

Figure 3:
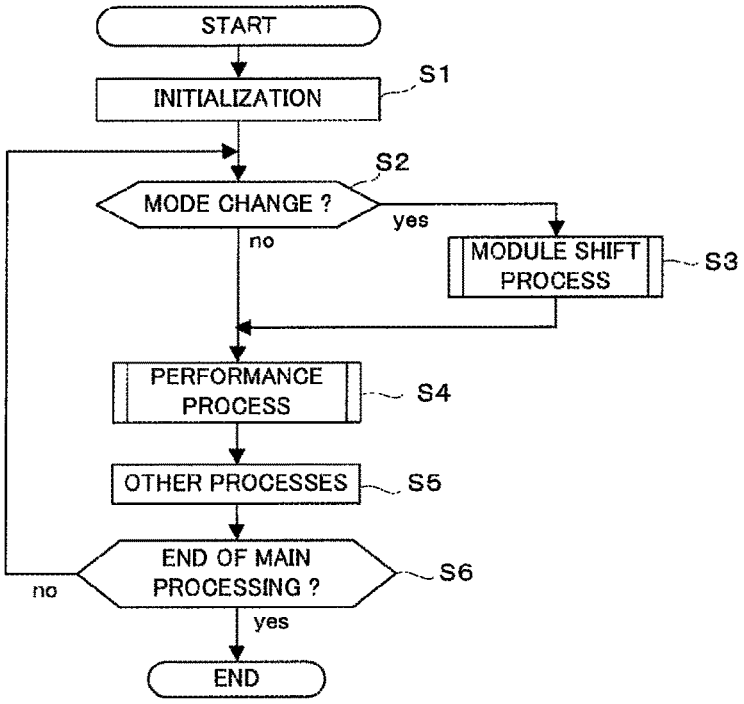
FIG. 3 is a flow chart showing an example of main processing of the electronic musical instrument shown in FIG. 2.

FIG. 3 is a flow chart showing example main processing of the electronic musical instrument 100, which is started up upon powering-on of the electronic musical instrument 100. First, at step S1, the CPU 1 starts execution of various control programs and performs an initialization process for setting respective predetermined initial values into various registers. Then, at step S2, the CPU 1 determines whether or not a mode selecting operation has been performed. If a mode change has been effected by the mode selecting operation, the CPU 1 performs a module shift process at step S3.

Figure 4:
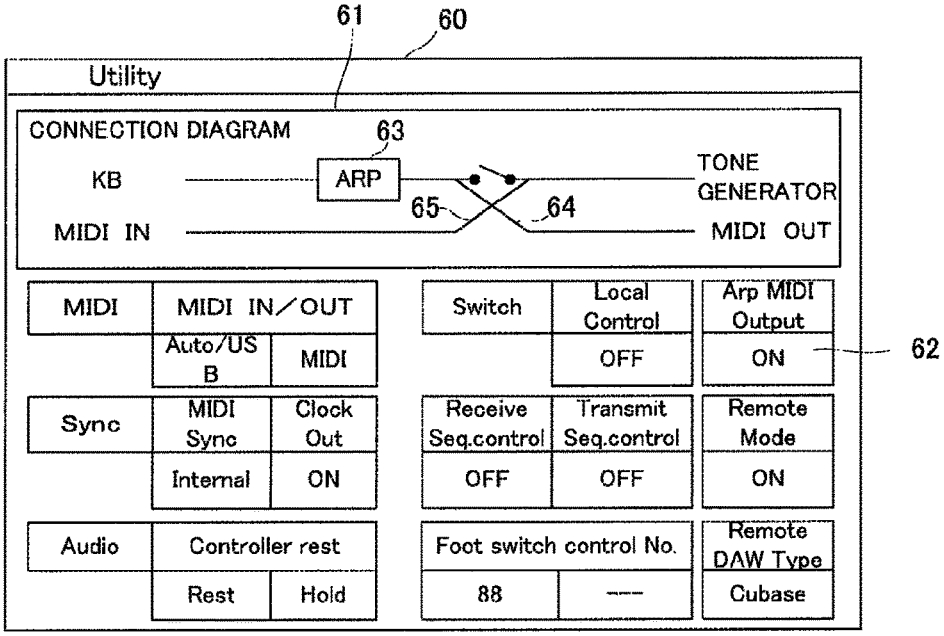
FIG. 4 is a diagram showing an example screen displaying a connection diagram on the electronic musical instrument.

The mode selecting operation, which is an operation for selecting any one of the first mode and second mode described above with reference to FIGS. 1A and 1B, is performed, via the setting operation section 5, by calling out a predetermined setting screen to the display device 6 and selecting any one of the first mode and second mode on the setting screen. FIG. 4 shows an example structure of the setting screen 60, on which are displayed a connection diagram 61 and images indicative of various connection-setting-related settings. For example, the user can select any one of the first mode and second mode by an ON/OFF setting of an arpeggiator MIDI output ("ArpMIDIoutput" in the figure) parameter 62 on the setting screen 60. For example, the arpeggiator MIDI output parameter 62 is set to ON to select the first mode, whereas the arpeggiator MIDI output parameter 62 is set to OFF to select the second mode. Thus, an operator or control for setting the arpeggiator MIDI output parameter 62 to ON or OFF functions a mode selector for selecting any one of the first and second modes by a user's operation.

Further, as shown in FIG. 4, the connection diagram 61 depicts the connection settings of FIGS. 1A and 1B by: letters "KB" indicative of the performance operation section 101; letters "MIDI IN" indicative of the second input section 102; letters "MIDI OUT" indicative of the first output section 103; letters "TG" indicative of the tone generator section 104: an image ("ARP" in the figure) 63 indicative of the arpeggiator 110; images indicative of switches; a line 64 indicative of the first path 105; and a line 65 indicative of the second path 106.

Figure 5:
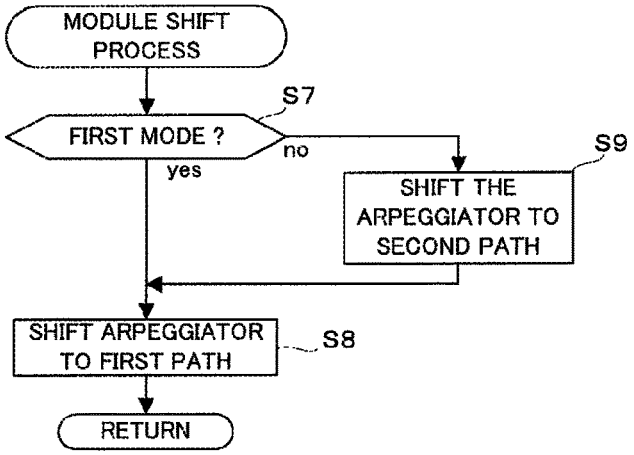
FIG. 5 is a flow chart showing an example of an arpeggiator module shift process shown in FIG. 3.

FIG. 5 is a flow chart showing an example of the module shift process at step S3 of FIG. 3. Once the first mode is selected (YES determination at step S7), the CPU 1 goes to step S8, where it makes connection settings such that the arpeggiator 110 is inserted in, or shifted to, the first path 105 as shown in FIG. 1A. Namely, in the first mode, the connection settings are made such that: the output of the performance operation section 101 is connected to the input of the arpeggiator 110; the output of the arpeggiator 110 is connected to the first output section 103; and the output of the second input section 102 is connected directly, —not by way of the arpeggiator 110—, to the input of the tone generator section 104. Once the second mode is selected (NO determination at step S7), on the other hand, the CPU 1 branches to step S9, where it makes connection settings such that the arpeggiator 110 is inserted in the second path 106 as shown in FIG. 1B. Namely, in the second mode, the connection settings are made such that: the output of the performance operation section 101 is connected directly, —not by way of the arpeggiator 110—, to the input of the first output section 103; the output of the second input section 102 is connected to the input of the arpeggiator 110; and the output of the arpeggiator 110 is connected to the input of the tone generator section 104.

Once the arpeggiator 110 is positionally shifted by the module shift process at step S3, the CPU 1 changes the display of the connection diagram 61 on the setting screen 60 of the display device 6. Namely, when the connection mode has been changed from the first mode to the second mode, the CPU 1 changes the display so as to shift the image 63 indicative of the arpeggiator 110 from a position on the line 64 indicative of the first path 105 to a position on the line 65 indicative of the second path 106, whereas when the connection mode has been changed from the second mode to the first mode, the CPU 1 changes the display so as to shift the image 63 indicative of the arpeggiator 110 from the position on the line 65 indicative of the second path 106 to the position on the line 64 indicative of the first path 105.

Referring back to FIG. 3, when an operation event of the performance operation section 4 has been detected or when performance information has been input from external equipment via the interface unit 9, the CPU 1 performs a performance process at step S4. The performance process at step S4 includes: a process for creating performance information based on a detected operation event; an arpeggio performance information creation process to be performed by the arpeggiator 110; a process to be performed by the tone generator circuit 7 for generating a tone signal based on performance information or arpeggio performance information: and a process for outputting performance information or arpeggio performance information to external equipment.

The performance process is performed at step S4 in the following manner when the first mode is selected. The CPU 1 creates, on the basis of an operation event acquired from the performance operation section 4, performance information including a note number, key-on or key-off data and a velocity. When a chord has been performed, for example, the CPU 1 creates performance information corresponding to individual tones (notes) constituting the performed chord. Then, the CPU 1 creates arpeggio performance information based on the created performance information and a given arpeggio pattern. As an example, data of a plurality of arpeggio patterns may be prestored in the memory 2, 3 or 8 of the electronic musical instrument 100 so that the user can select any desired one of arpeggio patterns. Further, the CPU 1 outputs the created arpeggio performance information to the PC 120 via the interface unit 9 (first output section 103). Also, the CPU 1 supplies to the tone generator circuit 7 arpeggio performance information input from the PC 120 via the interface unit 9 (second output section 102), so that the tone generator circuit 7 generates tone signals based on the supplied arpeggio performance information and then output via the sound system 10.

The performance process is performed at step S4 in the following manner when the second mode is selected. The CPU 1 creates performance information on the basis of an operation event acquired from the performance operation section 4, and outputs the thus-created performance information to the PC 120 via the interface unit 9 (first output section 103). The CPU 1 creates arpeggio performance information based on performance information input from the PC 120 via the interface unit 9 (second output section 102) and on an arpeggio pattern. Then, the CPU 1 supplies the thus-created arpeggio performance information to the tone generator circuit 7, so that tone generator circuit 7 generates a tone signal based on the supplied arpeggio performance information and then the thus-generated tone signal is sounded or audibly output via the sound system 10.

Further, at step S5 of FIG. 5, the CPU 1 performs various processes ("other processes" in FIG. 3) in response to other operations performed on the setting section 5 and the like. The other processes include, among other things, tone color setting, tone volume adjustment, selection of an arpeggio pattern and various other setting than the aforementioned connection mode setting.

The CPU 1 repeats the aforementioned operations of steps S2 to S5 until an end of the main processing is instructed by powering-off of the electronic musical instrument 100 (i.e., as along as a NO determination is made at step S6). Once an end of the main processing is instructed by powering-off of the electronic musical instrument 100 (i.e., once a YES determination is made at step S6), the main processing of FIG. 3 is brought to an end.

As apparent from the foregoing, appropriate connection settings of the arpeggiator 110 corresponding to a scene of use can be made by merely selecting any one of the first mode and second mode depending on the scene of use, i.e. whether 1) arpeggio performance information is to be recorded into the PC 120 or 2) performance information having not been passed through (i.e., having not been processed by) the arpeggiator 110 is to be recorded into the PC 120 and then processed by the arpeggiator 110 before reproduction. Because the connection settings of the tone processing module can be made by merely positionally shifting the arpeggiator 110, the connection settings made in the electronic musical instrument 100 are simple and intuitively easy to follow as compared to the conventionally-known technique in which respective ON/OFF settings of a plurality of switches are combined. Besides, it is possible to present the user with the connection diagram 61 that is simple and intuitively easy to follow.

Figure 6:
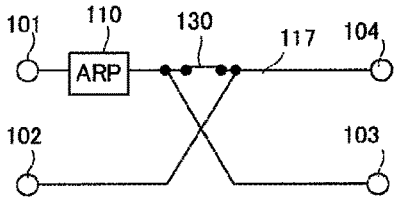
FIG. 6 is a conceptual block diagram explanatory of an example configuration of the electronic musical instrument when the electronic musical instrument is used independently.

When the PC 120 is to be used separately from, or independently of, the PC 120 by being disconnected from the PC 120, the local control switch 130 is turned on to interconnect the above-mentioned branch points 115 and 116 (see FIG. 1). The ON/OFF state of the local control switch 130 may be controlled either automatically by the CPU 1 or manually by the user. FIG. 6 is an example construction of the electronic musical instrument 100 when the electronic musical instrument 100 is used independently of the PC 120. As shown in FIG. 6, once the local control switch 130 is turned on, the branch points 115 and 116 are interconnected, so that a third path 117 is formed to connect the performance operation section 101 to the tone generator section 104. In this case, performance information corresponding to a performance operation, input via the performance operation section 101, is supplied to the tone generator section 104 through the arpeggiator 110 or without being passed through the arpeggiator 110. The ON/OFF state of the arpeggiator 110 is controllable in the well-known manner, e.g. by turning on/off of the arpeggiator function. Alternatively, the first mode may be selected with the OFF state of the local control switch 130 maintained or without providing the local control switch 130 in a condition where the first output section 103 is directly connected to the second input section 102 without providing the PC 120.

Figure 7:
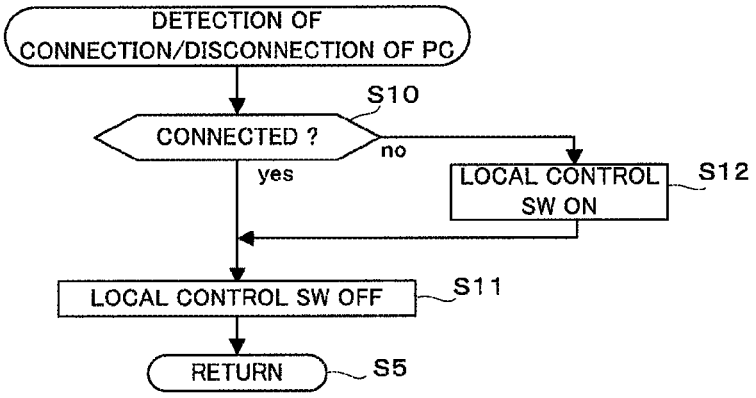
FIG. 7 is a flow chart showing an example of a local control switch ON/OFF process responsive to connection/disconnection of external equipment to/from the electronic musical instrument.

As an example, the electronic musical instrument 100 automatically controls the ON/OFF state of the local control switch 130 in response to connection/disconnection (non-connection) of the PC 120 to/from the electronic musical instrument 100. FIG. 7 is a flow chart showing an example of a process (automatic local control switch control process) for automatically controlling the ON/OFF state of the local control switch 130 in response to connection/disconnection (non-connection) of the PC 120 to/from the electronic musical instrument 100. The process of FIG. 7 is started in response to the CPU 1 detecting connection or disconnection of the PC 120 to or from the interface unit 9 (second input section 102 and first output section 103). Once the PC 120 is connected to the electronic musical instrument 100 (YES determination at step S10), the CPU 1 turns off the local control switch 130, i.e. sets the local control switch 130 to the OFF state, at step S11. Once the PC 120 is disconnected from the electronic musical instrument 100 (NO determination at step S10), on the other hand, the CPU 1 turns on the local control switch 130, i.e. sets the local control switch 130 to the ON state, at step S12. Thus, the connection settings of the electronic musical instrument 100 can be changed depending on the current scene of use, i.e. depending on whether the electronic musical instrument 100 is used connected to the PC 120 (i.e., in conjunction with the PC 120) or used disconnected from the PC 120 (i.e., independently of the PC 120). Such a setting change capability is extremely convenient to users who frequently switch between the independent (non-PC-connected) use of the electronic musical instrument 100 and the PC-connected use of the electronic musical instrument 100.

As another example, the electronic musical instrument 100 may be constructed in such a manner that the user can set, for example via the setting screen displayed on the display device 6, whether or not to execute the automatic ON/OFF control of the local control switch 130 in response to connection or disconnection of the PC 120 to or from the electronic musical instrument 100.

Figure 8:
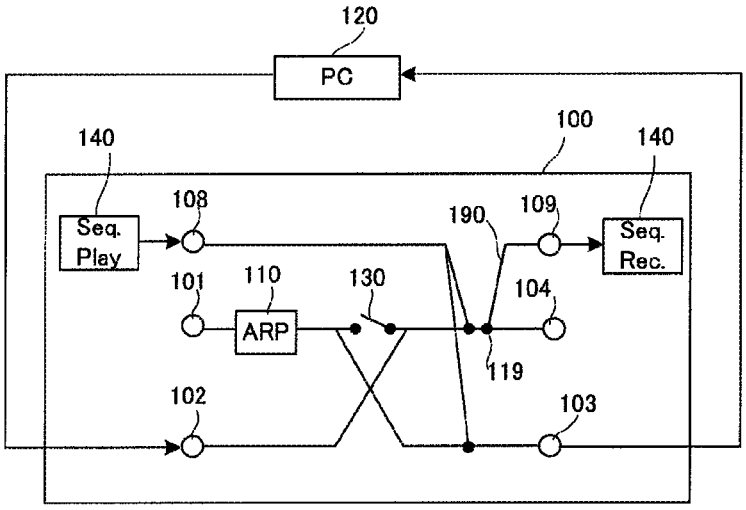
FIG. 8 is a block diagram conceptually showing an example overall setup of a modification of the electronic musical instrument of the present invention.

FIG. 8 is a modification of the electronic musical instrument 100. As shown, the modification of the electronic musical instrument 100 further includes a third input section 108 that inputs third tone data from other equipment 140 that is different from the PC 120, and a third output section 109 that outputs tone data to the other equipment 140. The other equipment 140 connected to the third input section 108 and the third output section 109 is a MIDI sequencer module built-in the electronic musical instrument 100. In this case, let it be assumed that an output process in the built-in MIDI sequencer module is in an OFF state. Namely let it be assumed that the tone data output from the third output section 109 to the MIDI sequencer 140 is not output by the MIDI sequencer 140 to the third input section 108 (i.e., not subjected to the output process in the built-in MIDI sequencer module 140). To show such an arrangement, the single MIDI sequencer 140 is depicted in FIG. 8 in two separate blocks, "Seq. Play" connected to the third input section 108 and "Seq. Rec." connected to the third output section 109. The third input section 108 is associated with both the first output section 103 and the tone generator section 104, so that tone data input via the external output section 108 (i.e., tone data output from the MIDI sequencer 140) can be supplied to the first output section 103 and/or the tone generator section 104. Further, the third output section 109 is connected to a path 190 branching from a branch point 119 provided immediately before the tone generator section 104 so as to output, via the path 190, the same tone data as the one supplied to the tone generator section 104. Namely, the same tone data as the one supplied to the tone generator section 10 can be supplied to the MIDI sequencer 140 via the third output section 109. Note that the other equipment 140 is not necessarily limited to the MIDI sequencer and may be any other type of processing module built in the electronic musical instrument 100. Further, the MIDI sequencer 140 may be other than such a processing module built in the electronic musical instrument 100, such as some type of external equipment like MIDI equipment or an audio mixer externally connected to the electronic musical instrument 100. Also note that the modification of the electronic musical instrument 100 of FIG. 8 is similar in construction to the electronic musical instrument 100 shown in FIGS. 1A, 1B, etc., except for the third input section 108 and third output section 109 and paths related to the third input section 108 and third output section 109. Such components and features similar to the above-described will not be described below to avoid unnecessary duplication.

Figure 9:
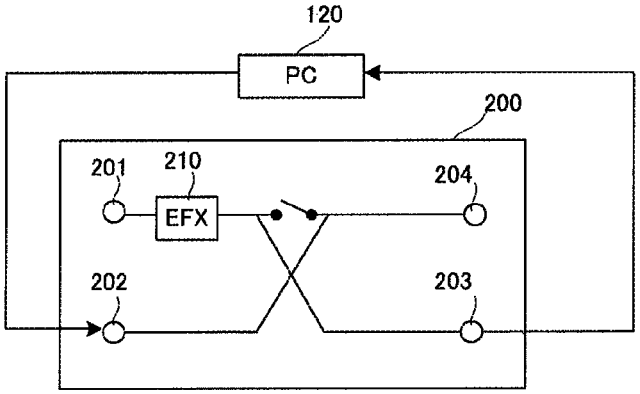
FIG. 9 is a block diagram showing an example construction of a sound effect impartment apparatus to which are applied another embodiment of the musical equipment of the present invention.

Further, FIG. 9 is a block diagram showing an example construction of a sound effect impartment apparatus 200 to which is applied another embodiment of the musical equipment of the present invention. The sound effect impartment apparatus 200 includes: a first audio input section 201 that inputs a first audio signal; a second audio input section 202 that inputs a second audio signal: a first audio output section 203 associated with the first audio input section 201; a second audio output section 204 associated with the second audio input section 202; and an effector module ("EFX") 210 that imparts a sound effect, such as reverberation or delay, to the first audio signal or second audio signal. In the illustrated example, the effector module ("EFX") 210 functions as a tone processing module that performs tone processing (i.e., sound effect impartment) on input tome data. External equipment, such as the PC 120, is connected to the second audio input section 202 and the first audio output section 203, so that an audio signal output from the first audio output section 203 is input to the PC 120 and an audio signal output from the PC 120 is input to the second audio input section 202. In this case too, the effecter module 210 is positionally shifted in such a manner that the effecter module 210 is inserted into a first path, connecting the first audio input section 201 to the first audio output section 203, in response to selection of the first mode, and that the effecter module 210 is inserted into a second path, connecting the second audio input section 202 to the second audio output section 204, in response to selection of the second mode. In this way, the connections of the effecter module 210 can be set appropriately by merely selecting an appropriate connection mode depending on a scene of use.

It should be appreciated that the present invention is not limited to the above-described embodiments and may be modified variously within the scope of the technical idea disclosed in the claims, specification and drawings.

For example, the constructions shown in FIGS. 1A and 1B may be modified so that an audio signal is output from the electronic musical instrument 100 to the PC 120 and an audio signal is output from the PC 120 to the electronic musical instrument 100.

Further, the musical equipment of the present invention is applicable not only as the above-described electronic musical instrument 100 including the performance operation section, but also as any other types of musical equipment handing performance information prepared in the MIDI format, such as a tone generator apparatus having no performance operation section and an electronic keyboard instrument having no tone generator section. Furthermore, the musical equipment of the present invention is applicable not only as the above-described sound effect impartment apparatus 200, but also as any other types of musical equipment handling audio signals, such as a digital mixer, an audio signal processing apparatus and recording/reproducing equipment.

Furthermore, the external equipment 120 connected to the musical equipment of the present invention is not necessarily limited to a PC and may be any other type of equipment handling tone data, such as an electronic musical instrument, a tone generator apparatus, a multi-track recording apparatus, an audio mixer or an effecter.

Furthermore, whereas the foregoing have described the module shift process of step S3 as making the connection settings of the tone processing module 110 by positionally shifting the tone processing module 110 in accordance with the mode setting. However, as a modification of the module shift process of step S3, the connection settings of the tone processing module 110 may be merely visually presented to the user in a simple fashion by positionally shifting the tone processing module 110 on the display of the connection diagram 61 (i.e., by shifting the displayed position of the tone processing module 110). In this case, the connection settings of the tone processing module 110 may themselves be made by a combination of ON/OFF settings of a plurality of switches. In this case, even where actual connections and settings of the switches are more or less complicated, the display of the connection settings which is simple and easily-to-follow to the user can be presented to the user.

Furthermore, the automatic local control switch control process of FIG. 7 may be started in response to detection of connection or disconnection of the external equipment 120 to or from at least one of the second input section 102 and the first output section 103.

Furthermore, the tone processing modules 110 and 210 are not limited to those comprising program modules executable by a CPU (processor) as described above and may comprise dedicated hardware apparatus. In such a case, the tone processing modules 110 and 210, which are dedicated hardware apparatus, may each be positionally shifted by switching among pluralities of input and output paths of the tone processing module 110 or 210 by control of the CPU (processor). What is more, selection of the first mode or second mode may be made not only by a user's operation on the setting operation section 5, but also in accordance with mode selection information. For example, such mode selection information may be incorporated in advance in an automatic music performance program so that it can be supplied to the aforementioned operation of step S2 in response to execution, by the electronic musical instrument 100, of the automatic music performance program, or may be supplied to the electronic musical instrument 100 from the outside via a communication line.

This application is based on, and claims priority to, JP PA 2015-215890 filed on 2 Nov. 2015. The disclosure of the priority application, in its entirety, including the drawings, claims, and the specification thereof are incorporated herein by reference.

What is claimed is:

1. A musical equipment comprising:

a first input for first tone data;

a second input for second tone data;

a first output connected to the first input via a first path;

a second output connected to the second input via a second path;

a processor configured to insert a tone processing function of performing tone processing on input tone data into the first path when responding to selection of a first mode and insert the tone processing function into the second path when responding to selection of a second mode; and a switch that selectively connects a first branch point in the first path and a second branch point in the second path to each other, wherein dedicated circuitry or the processor, when executing instructions stored in a memory, performs the tone processing function of performing tone processing on the first tone data, when input via the first input, in the first mode, and performs the tone processing function of performing tone processing on the second tone data, when input via the second input, in the second mode, wherein the first branch point is located on an output side of the tone processing function in the first path, and the second branch point is located on an input side of the tone processing function in the second path, and wherein the switch is turned ON to connect the first branch point and the second branch point to each other to form a third path connecting the first input to the second output.

2. The musical equipment as claimed in claim 1, which further comprises a display configured to display which of the first path and the second path the tone processing function is being inserted in.

3. The musical equipment as claimed in claim 1, wherein the processor is configured to, at least in response to selection of the second mode, set the switch to OFF to prevent connection between the first branch point and the second branch point.

4. The musical equipment as claimed in claim 1, wherein the processor is configured to, at least on condition that the second tone data is not being input to the second input, set the switch to ON to connect the first branch point and the second branch point to each other.

5. The musical equipment as claimed in claim 1, wherein the tone processing function comprises an arpeggiator function of automatically creating arpeggio performance information, indicative of arpeggio performance tones, based on the input tone data.

6. The musical equipment as claimed in claim 1, wherein the tone processing function comprises an effecter function of imparting a sound effect to the input tone data.

7. A musical equipment comprising:

a first input for first tone data;

a second input for second tone data;

a first output connected to the first input via a first path;

a second output connected to the second input via a second path;

a processor configured to insert a tone processing function of performing tone processing on input tone data into the first path when responding to selection of a first mode and insert the tone processing function into the second path when responding to selection of a second mode; and a switch that selectively connects a first branch point in the first path and a second branch point in the second path to each other, wherein dedicated circuitry or the processor, when executing instructions stored in a memory, performs the tone processing function of performing tone processing on the first tone data, when input via the first input, in the first mode, and performs the tone processing function of performing tone processing on the second tone data, when input via the second input, in the second mode, wherein the processor is configured to set the switch to OFF in the case where the first output is connected to an input of external equipment and the second input is connected to an output of the external equipment, and to set the switch to ON in the case where the external equipment is connected to neither the first output nor the second input of the musical equipment, and wherein the switch is turned ON to connect the first branch point and the second branch point to each other, to form a third path connecting the first input to the second output.

8. The musical equipment as claimed in claim 1, wherein the first mode is selected in response to connection of the first output to an input of external equipment, so that output data of the tone processing function, obtained through the tone processing on the first tone data is input to the external equipment.

9. A musical equipment comprising:

a first input for tone data;

a second input for second tone data;

a first output connected to the first input via a first path;

a second output connected to the second input via a second path; and a processor configured to insert a tone processing function of performing tone processing on input tone data into the first path when responding to selection of a first mode and insert the tone processing function into the second path when responding to selection of a second mode, wherein dedicated circuitry or the processor, when executing instructions stored in a memory, performs the tone processing function of performing tone processing on the first tone data, when input via the first input, in the first mode, and performs the tone processing function of performing tone processing on the second tone data, when input via the second input, in the second mode, wherein the second output includes a tone generator circuit that generates a tone signal based on input tone data, and wherein the first mode is selected in response to connection of the first output to the second input so that output data of the tone processing function output from the first output is returned to the second input so that the output data of the tone processing function is supplied to the tone generator circuit.

10. The musical equipment as claimed in claim 9, wherein an external equipment is provided between the first output and the second input.

11. The musical equipment as claimed in claim 9, which further comprises a display configured to display which of the first path and the second path the tone processing function is being inserted in.

12. The musical equipment as claimed in claim 9, wherein the tone processing function comprises an arpeggiator function of automatically creating arpeggio performance information, indicative of arpeggio performance tones, based on the input tone data.

13. The musical equipment as claimed in claim 9, wherein the tone processing function comprises an effecter function of imparting a sound effect to the input tone data.

14. A method for performing tone processing in musical equipment, the musical equipment including: a first input for first tone data; a second input for second tone data; a first output connected to the first input via a first path; and a second output connected to the second input via a second path, the method comprising:

inserting, by a processor, a tone processing function of performing tone processing on input tone data into the first path when responding to selection of a first mode;

inserting, by the processor, the tone processing function into the second path when responding to selection of a second mode; and in response to an operation of a switch, selectively connecting a first branch point in the first path and a second branch point in the second path to each other, wherein dedicated circuitry or the processor, when executing instructions stored in a memory, performs the tone processing function of performing tone processing on the first tone data, when input via the first input, in the first mode, and performs the tone processing function of performing tone processing on the second tone data, when input via the second input, in the second mode, wherein the first branch point is located on an output side of the tone processing function in the first path, and the second branch point is located on an input side of the tone processing function in the second path, and wherein the switch is turned ON to connect the first branch point and the second branch point to each other to form a third path connecting the first input to the second output.

15. A non-transitory machine-readable storage medium containing a program executable by a processor to perform a method for performing tone processing in musical equipment, the musical equipment including: a first input for first tone data; a second input for second tone data; a first output connected to the first input via a first path; and a second output connected to the second input via a second path, the method comprising:

inserting a tone processing function of performing tone processing on input tone data into the first path when responding to selection of a first mode;

inserting a tone processing function into the second path when responding to selection of a second mode; and in response to an operation of a switch, selectively connecting a first branch point in the first path and a second branch point in the second path to each other, wherein dedicated circuitry or the processor, when executing instructions stored in a memory, performs the tone processing function of performing tone processing on the first tone data, when input via the first input, in the first mode, and performs the tone processing function of performing tone processing on the second tone data, when input via the second input, in the second mode, wherein the first branch point is located on an output side of the tone processing function in the first path, and the second branch point is located on an input side of the tone processing function in the second path, and wherein the switch is turned ON to connect the first branch point and the second branch point to each other to form a third path connecting the first input to the second output.

16. A method for performing tone processing in musical equipment, the musical equipment including: a first input for first tone data; a second input for second tone data; a first output connected to the first input via a first path; and a second output connected to the second input via a second path, the method comprising:

inserting, by a processor, a tone processing function of performing tone processing on input tone data into the first path when responding to selection of a first mode; and inserting, by the processor, the tone processing function into the second path when responding to selection of a second mode, wherein dedicated circuitry or the processor, when executing instructions stored in a memory, performs the tone processing function of performing tone processing on the first tone data, when input via the first input, in the first mode, and performs the tone processing function of performing tone processing on the second tone data, when input via the second input, in the second mode, wherein the second output includes a tone generator circuit that generates a tone signal based on input tone data, and wherein the first mode is selected in response to connection of the first output to the second input so that output data of the tone processing function output from the first output is returned to the second input so that the output data of the tone processing function is supplied to the tone generator circuit.

* * * * *